US009494033B2

(12) United States Patent
Taherian et al.

(10) Patent No.: US 9,494,033 B2
(45) Date of Patent: Nov. 15, 2016

(54) APPARATUS AND METHOD FOR KICK DETECTION USING ACOUSTIC SENSORS

(75) Inventors: Reza Taherian, Sugar Land, TX (US); Fernando Garcia-Osuna, Sugar Land, TX (US)

(73) Assignee: INTELLISERV, LLC, Houston, TX (US)

( * ) Notice: Subject to any disclaimer, the term of this patent is extended or adjusted under 35 U.S.C. 154(b) by 823 days.

(21) Appl. No.: 13/530,463

(22) Filed: Jun. 22, 2012

(65) Prior Publication Data

US 2013/0341094 A1 Dec. 26, 2013

(51) Int. Cl.

| | |
|---|---|
| ***E21B 47/14*** | (2006.01) |
| ***E21B 21/08*** | (2006.01) |
| ***E21B 47/10*** | (2012.01) |
| ***E21B 21/10*** | (2006.01) |

(52) U.S. Cl.

CPC ..... *E21B 47/14* (2013.01); *E21B 21/08* (2013.01); *E21B 21/10* (2013.01); *E21B 47/10* (2013.01)

(58) Field of Classification Search

None

See application file for complete search history.

(56) References Cited

U.S. PATENT DOCUMENTS

| | | | |
|---|---|---|---|
| 4,273,212 | A | 6/1981 | Dorr et al. |
| 4,297,880 | A | 11/1981 | Berger |
| 4,606,415 | A | 8/1986 | Gray, Jr. et al. |
| 5,184,508 | A | 2/1993 | Desbrandes |
| 5,469,736 | A | 11/1995 | Moake |
| 5,887,657 | A | 3/1999 | Bussear et al. |
| 5,934,371 | A | 8/1999 | Bussear et al. |
| 5,959,547 | A | 9/1999 | Tubel et al. |
| 6,208,586 | B1 * | 3/2001 | Rorden et al. ..... 367/35 |
| 6,233,524 | B1 | 5/2001 | Harrell et al. |
| 6,252,518 | B1 | 6/2001 | Laborda |
| 6,374,913 | B1 | 4/2002 | Robbins et al. |
| 6,415,231 | B1 | 7/2002 | Hebert |
| 6,415,877 | B1 | 7/2002 | Fincher et al. |
| 6,615,933 | B1 | 9/2003 | Eddison |
| 6,648,081 | B2 | 11/2003 | Fincher et al. |
| 6,648,082 | B2 | 11/2003 | Schultz et al. |

(Continued)

FOREIGN PATENT DOCUMENTS

| | | | |
|---|---|---|---|
| EA | 007962 | B1 | 2/2007 |
| WO | 2007016687 | A1 | 2/2007 |

OTHER PUBLICATIONS

Sperry Drilling Services, "PWD (Pressure White Drilling) Sensor", Aug. 2007 (2 pages).

(Continued)

*Primary Examiner* — Jennifer H Gay
*Assistant Examiner* — Caroline Butcher
(74) *Attorney, Agent, or Firm* — Conley Rose, P.C.

(57) ABSTRACT

A method and apparatus for detecting a kick in a wellbore using acoustic transducers. In one embodiment, a system for detecting a kick in a wellbore includes a drill string having a plurality of sections of drill pipes and a plurality of kick detection subs disposed between the sections of drill pipes. Each of the kick detection subs includes an acoustic transducer and kick detection circuitry coupled to the acoustic transducer. The kick detection circuitry is configured to detect gas bubbles in the wellbore based on acoustic signals received by the acoustic transducer. The kick detection circuitry is also configured to determine whether a kick is present in the wellbore based on the detected gas bubbles. The kick detection circuitry is further configured to transmit information indicating whether a kick is present to the surface.

29 Claims, 7 Drawing Sheets

(56) References Cited

U.S. PATENT DOCUMENTS

| | | | |
|---|---|---|---|
| 6,659,197 | B2 | 12/2003 | Cooper |
| 6,670,880 | B1 | 12/2003 | Hall et al. |
| 6,712,160 | B1 | 3/2004 | Schultz et al. |
| 6,717,501 | B2 | 4/2004 | Hall et al. |
| 6,722,450 | B2 | 4/2004 | Schultz |
| 6,725,162 | B2 | 4/2004 | Edwards et al. |
| 6,732,052 | B2 | 5/2004 | MacDonald |
| 6,768,106 | B2 | 7/2004 | Gzara et al. |
| 6,821,147 | B1 | 11/2004 | Hall et al. |
| 6,830,467 | B2 | 12/2004 | Hall et al. |
| 6,844,498 | B2 | 1/2005 | Hall et al. |
| 6,854,532 | B2 | 2/2005 | Fincher et al. |
| 6,868,920 | B2 | 3/2005 | Holeit et al. |
| 6,888,473 | B1 | 5/2005 | Hall et al. |
| 6,986,282 | B2 | 1/2006 | Cigienec et al. |
| 7,044,237 | B2 | 5/2006 | Leuchtenberg |
| 7,062,959 | B2 | 6/2006 | Kurkjian et al. |
| 7,082,821 | B2 | 8/2006 | Chen et al. |
| 7,139,218 | B2 | 11/2006 | Hall et al. |
| 7,174,975 | B2 | 2/2007 | Krueger et al. |
| 7,201,221 | B2 | 4/2007 | Tubel et al. |
| 7,207,396 | B2 | 4/2007 | Hall et al. |
| 7,270,185 | B2 | 9/2007 | Fontana et al. |
| 7,284,903 | B2 | 10/2007 | Hartog |
| 7,311,142 | B2 | 12/2007 | Fisseier et al. |
| 2004/0039466 | A1 | 2/2004 | Lilly et al. |
| 2004/0104797 | A1 | 6/2004 | Hall et al. |
| 2004/0113808 | A1 | 6/2004 | Hall et al. |
| 2004/0145492 | A1 | 7/2004 | Hall et al. |
| 2004/0150532 | A1 | 8/2004 | Hall et al. |
| 2005/0001735 | A1 | 1/2005 | Hall et al. |
| 2005/0092488 | A1 | 5/2005 | Rodet et al. |
| 2005/0092499 | A1 | 5/2005 | Hall et al. |
| 2005/0161215 | A1 | 7/2005 | Hall et al. |
| 2005/0173128 | A1 | 8/2005 | Hall et al. |
| 2005/0194182 | A1 | 9/2005 | Rodney et al. |
| 2005/0194184 | A1 | 9/2005 | Gleitman |
| 2005/0200498 | A1 | 9/2005 | Gleitman |
| 2005/0223808 | A1 | 10/2005 | Myers et al. |
| 2005/0284663 | A1 | 12/2005 | Hall et al. |
| 2006/0065402 | A9 | 3/2006 | Fontana et al. |
| 2006/0157282 | A1 | 7/2006 | Tilton et al. |
| 2007/0017671 | A1 | 1/2007 | Clark et al. |
| 2007/0029112 | A1 | 2/2007 | Li et al. |
| 2007/0030167 | A1 | 2/2007 | Li et al. |
| 2007/0045006 | A1 | 3/2007 | Krueger et al. |
| 2007/0188344 | A1 | 8/2007 | Hache et al. |
| 2007/0257809 | A1* | 11/2007 | Camwell et al. ..... 340/853.7 |
| 2007/0263488 | A1 | 11/2007 | Clark |
| 2007/0272033 | A9 | 11/2007 | Jones |
| 2008/0041576 | A1 | 2/2008 | Patel |
| 2008/0047337 | A1* | 2/2008 | Chemali et al. ..... 73/152.19 |
| 2008/0135291 | A1 | 6/2008 | Hall et al. |
| 2009/0173150 | A1 | 7/2009 | DiFoggio et al. |
| 2010/0170673 | A1 | 7/2010 | Krueger et al. |

OTHER PUBLICATIONS

Petrobras Emerging Well Technologies; by PLACIDO, Joao Carlos Ribeiro, et al., Drilling & Well Technology, Oil & Gas Review, 2007 OTC Edition (4 pages).

IADE/SPE 112636; High Speed Telemetry Drill Pipe Network Optimizes Drilling Dynamics and Wellbore Placement, Ali, T. H., et al., 200B (8 pages).

IADE/SPE 112702. The Utilization of the Massive Amount of Real Time Data Acquired in Wired Drillpipe Operations, Olberg, et al., (13 pages).

IADC/SPE 115206, Evolution of Innovative Test Methodology for Evaluation or Hardfacing Materials in both Cased and Open Environments; Chan, Alvaro, et al., SPE International, 2008 (15 pages).

IADC/SPE 112740 Evolution of Drilling Programs and Complex Well Profiles Drive Development of Fourth-Generation Hardband Technology, Chan, Alvaro, et al 2008 (17 pages).

Russian Patent Application No. 2010137427 Office Action dated Nov. 19, 2012.

International Patent Application No. PCT/US2013/046355, International Search Report and Written Opinion dated Sep. 25, 2013.

* cited by examiner

APPARATUS AND METHOD FOR KICK DETECTION USING ACOUSTIC SENSORS

BACKGROUND

When drilling earthen formations in pursuit of hydrocarbons or other resources, drilling fluid, also known as "mud," is pumped into the wellbore. The drilling fluid lubricates the drill bit, transports borehole cuttings to the surface, and maintains wellbore pressure. If the pressure of the fluids in the formations being drilled accidentally or intentionally exceeds the pressure of the drilling fluid in the wellbore, an under balance situation arises, and fluid flows from the formations into the wellbore. Under such conditions, especially if a high pressure gas zone is drilled, the gas flows from the formations into the wellbore and travels toward the surface to produce what is known as a "kick." A kick is a safety concern in drilling operations as the gas can interfere with mud flow and upon reaching the surface can inadvertently be set aflame or caused to explode.

If a kick can be detected and the rig operator notified before the kick reaches the surfaces, the operator can take actions reduce and/or eliminate adverse effects of the kick. Accordingly, techniques for timely detection of a kick are desirable.

SUMMARY

A method and apparatus for detecting a kick in a wellbore using acoustic sensors are disclosed herein. In one embodiment, method for kick detection includes distributing acoustic transducers along a drill string at longitudinal positions separated by at least one length of drill pipe. A borehole is drilled with the drill string such that at least one of the acoustic transducers is always above a depth at which gas bubbles form in drilling fluid about the drill string. Via the acoustic transducers, whether gas bubbles are present in the drilling fluid is detected. Information derived from the detecting is transmitted to the surface.

In another embodiment, a system for detecting a kick in a wellbore includes a drill string having a plurality of sections of drill pipes and a plurality of kick detection subs disposed between the sections of drill pipes. Each of the kick detection subs includes an acoustic transducer and kick detection circuitry coupled to the acoustic transducer. The kick detection circuitry is configured to detect gas bubbles in the wellbore based on acoustic signals received by the acoustic transducer. The kick detection circuitry is also configured to determine whether a kick is present in the wellbore based on the detected gas bubbles. The kick detection circuitry is further configured to transmit information indicating whether a kick is present to the surface.

In a further embodiment, apparatus for in wellbore kick detection includes a plurality of wired drill pipe (WDP) repeaters. Each of the plurality of WDP repeaters is configured to retransmit signals through a WDP telemetry system disposed in the wellbore. The WDP repeaters are spaced by interposing wired drill pipes to maintain one of the WDP repeaters in proximity to a zone of bubble formation in drilling fluid as the wellbore is drilled. Each of the plurality of WDP repeaters includes a kick detection system. The kick detection system includes one or more acoustic transducers and kick detection logic coupled to the one or more acoustic transducers. The kick detection logic is configured to identify the presence and location of a kick in the wellbore based on acoustic signals indicative of bubble formation received by the one or more acoustic transducers. The kick detection logic is also configured to communicate information identifying the presence and location of the kick to the surface via the WDP telemetry system.

In a yet further embodiment, a system for kick detection in a cased wellbore includes a casing string disposed in the wellbore. The casing string includes a plurality of wired casing pipes including a casing telemetry system. One or more of the casing pipes are configured to detect gas in the wellbore fluid. The one or more casing pipes include an acoustic transducer and a kick detection system coupled to the acoustic transducer. The kick detection system is configured to identify the presence of gas in the wellbore based on acoustic signals indicative of bubble formation received by the one or more acoustic transducers. The kick detection system is also configured to communicate information identifying the presence of the gas in the wellbore to the surface via the casing telemetry system.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form in the interest of clarity and conciseness.

NOTATION AND NOMENCLATURE

Figure 1:
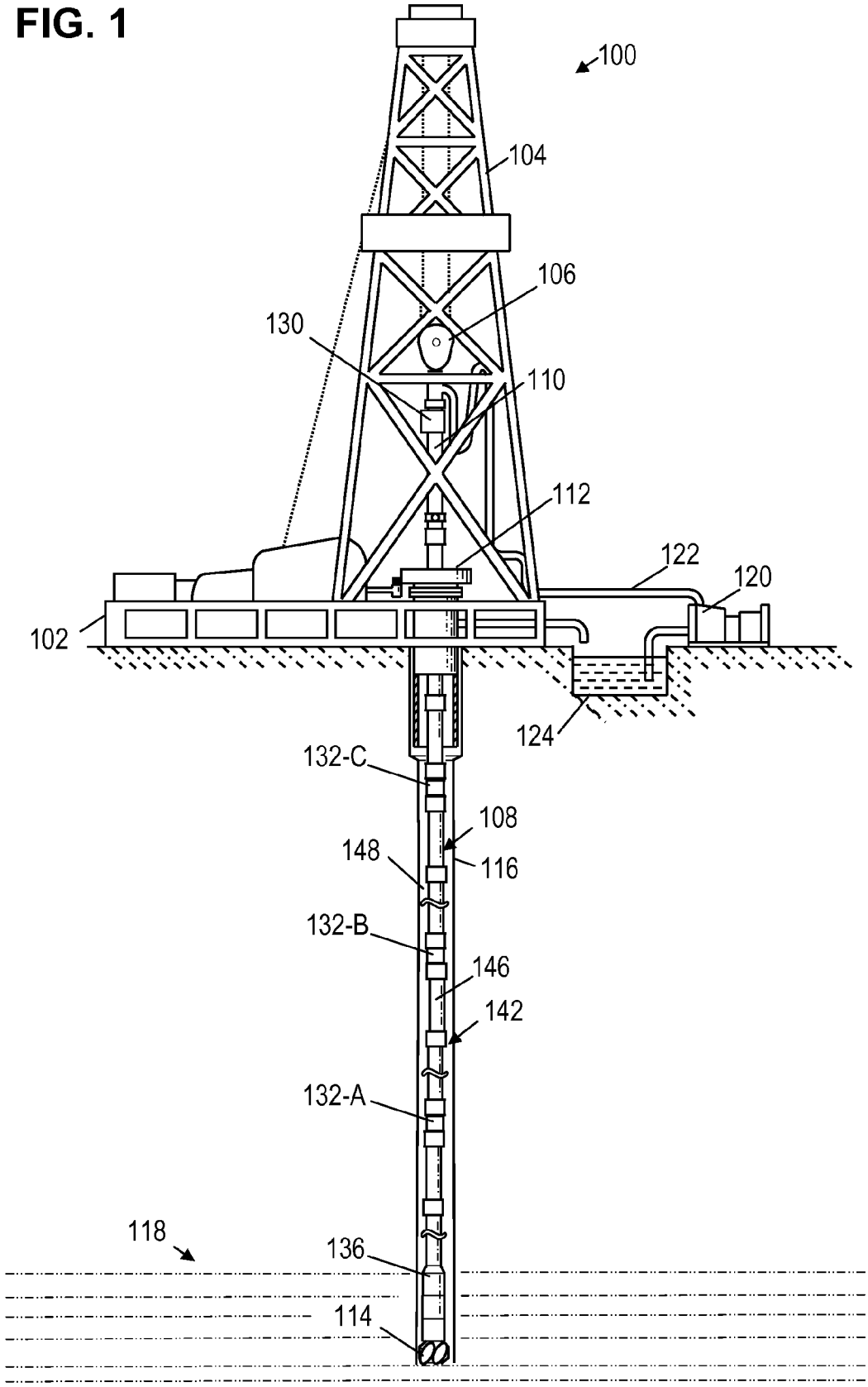
FIG. 1 shows a system for kick detection while drilling a wellbore in accordance with principles disclosed herein.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through direct engagement of the devices or through an indirect connection via other devices and connections. The recitation "based on" is intended to mean "based at least in part on." Therefore, if X is based on Y, X may be based on Y and any number of other factors.

DETAILED DESCRIPTION

The following discussion is directed to various embodiments of the invention. The embodiments disclosed should not be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

When gas flows from earthen formations into drilling fluid, the behavior of the gas is dictated by the downhole pressure. At high downhole pressures, the gas may be in liquid form or if some liquid hydrocarbons are present, the gas may be dissolved in the liquid hydrocarbons. As the mixture travels towards the surface, the pressure of the drilling fluid decreases. At some depth, the pressure drops below the "bubble point," which is the pressure at which the dissolved gas in liquid hydrocarbon boils off and forms bubbles in the drilling fluid.

Embodiments of the present disclosure apply acoustic techniques to detect a kick based on the formation of gas bubbles downhole. Because bubble formation is governed by fluid pressure, gas bubbles may not form at the downhole end of the drill string, but rather may form at shallower depths where monitoring tools are generally lacking. Embodiments disclosed herein include acoustic transducers distributed along the drill string to detect gas bubbles proximate the point of bubble formation. In some embodiments, acoustic transducers are disposed in wired drill pipe repeaters that are dispersed along the drill string, and kick detection information is transmitted to the surface via the high-speed telemetry provided by the wired drill pipe. Thus, embodiments of the acoustic kick detection system disclosed herein provide timely kick detection information to the drilling system by detecting the kick proximate the bubble point and relaying the information to the surface via high-speed telemetry.

FIG. 1 shows a system 100 for kick detection while drilling a wellbore in accordance with principles disclosed herein. In the system 100, a drilling platform 102 supports a derrick 104 having a traveling block 106 for raising and lowering a drill string 108. A kelly 110 supports the drill string 108 as it is lowered through a rotary table 112. In some embodiments, a top drive is used to rotate the drill string 108 in place of the kelly 110 and the rotary table 112. A drill bit 114 is positioned at the downhole end of the bottom hole assembly 136, and is driven by rotation of the drill string 108 or by a downhole motor (not shown) positioned in the bottom hole assembly 136 uphole of the drill bit 114. As the bit 114 rotates, it removes material from the various formations 118 and creates the wellbore 116. A pump 120 circulates drilling fluid through a feed pipe 122 and downhole through the interior of drill string 108, through orifices in drill bit 114, back to the surface via the annulus 148 around drill string 108, and into a retention pit 124. The drilling fluid transports cuttings from the wellbore 116 into the pit 124 and aids in maintaining the integrity of the wellbore 116.

In the system 100, the drill string 108 includes a plurality of sections (or joints) of wired drill pipe 146. Each section of wired drill pipe 146 includes a communicative medium (e.g., a coaxial cable, twisted pair, etc.) structurally incorporated or embedded over the length of the section, and an interface at each end of the section for communicating with an adjacent section. The communicative medium is connected to each interface. In some embodiments, the interface may include a coil about the circumference of the end of the section for forming an inductive connection with the adjacent section. The high bandwidth of the wired drill pipe 146 allows for transfers of large quantities of data at a high transfer rate.

Embodiments of the drill string 108 include kick detection subs 132 (subs 132 A, B, and C are shown) interspersed among the sections of wired drill pipe 146. In some embodiments of the system 100, a kick detection sub 132 may be integrated into a joint of wired drill pipe 146. In some embodiments, the kick detection subs 132 are included in wired drill pipe telemetry repeaters that are distributed along the drill string 108 to extend the reach of the wired drill pipe telemetry network. By positioning the kick detection subs 132 at intervals within the drill string 108, the system 100 ensures that a kick introduced at any depth of the drill string 108 can be detected in a timely fashion. By incorporating the kick detection sub 132 in a wired drill pipe telemetry repeater sub, no additional subs are added to the drill string 108, and kick information can be readily provided to the surface via high-speed wired drill pipe telemetry, allowing the system 100 to react to the kick before the kick reaches the surface. Additionally, as different ones of the kick detection subs 132 detect a rising gas bubble, embodiments of the system 100 may apply the difference in detection times to determine the speed of the rising gas bubble, and provide the speed information to an operator or other equipment.

While the system 100 is illustrated with reference to an onshore well and drilling system, embodiments of the system 100 are also applicable to kick detection in offshore wells. In such embodiments, the drill string 108 may extend from a surface platform through a riser assembly, a subsea blowout preventer, and a subsea wellhead into the formations 118.

Figure 2:
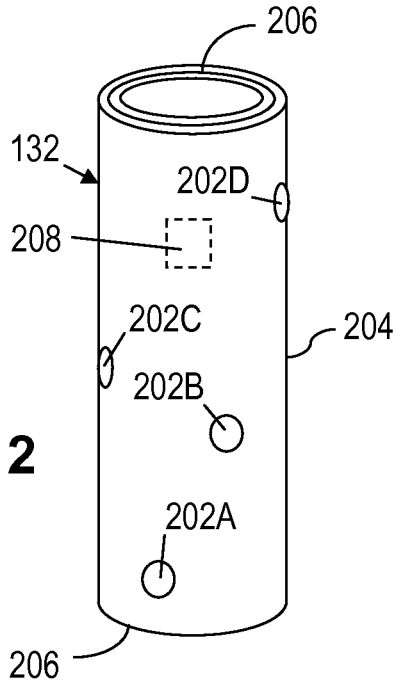
FIG. 2 shows an embodiment of a kick detection sub in accordance with principles disclosed herein.

FIG. 2 shows an embodiment of a kick detection sub 132 in accordance with principles disclosed herein. The kick detection sub 132 includes a generally cylindrical housing 204, and one or more acoustic transducers 202 (transducers 202A-D are shown) and kick detection logic 208. Each end of the kick detection sub 132 includes an interface 206 for communicatively coupling the sub 132 to a section of wired drill pipe 116 or another component configured to operate with the wired drill pipe telemetry system. In some embodiments of the kick detection sub 132, the interface 206 may be an inductive coupler. In some embodiments, the kick detection sub 132 is a wired drill pipe telemetry repeater sub.

The one or more acoustic transducers 202 may include an acoustic transmitter and/or an acoustic receiver for inducing and/or detecting acoustic signals in the drilling fluid about the kick detection sub 132. The one or more acoustic transducers 202 may include piezoelectric elements, electromagnetic elements, hydrophones, and/or other acoustic signal generation or detection technologies. The one or more acoustic transducers 202 may be positioned in a variety of different arrangements in accordance with various embodiments of the kick detection sub 132.

The kick detection logic 208 is coupled to the one or more acoustic transducers 202 and controls the generation of acoustic signals by the transducers 202. The kick detection logic 208 also processes acoustic signals detected by the acoustic transducers 202 to determine whether a kick is present in the drilling fluid about the kick detection sub 132. The kick detection logic 208 is coupled to the wired drill pipe telemetry system, or other downhole telemetry system, for communication of kick information to the surface. Additionally, the kick detection logic 208 may determine the speed of the rising bas bubble based on the different times of bubble detection of the different acoustic transducers 202, and provide the bubble speed information to the surface.

Figure 3:
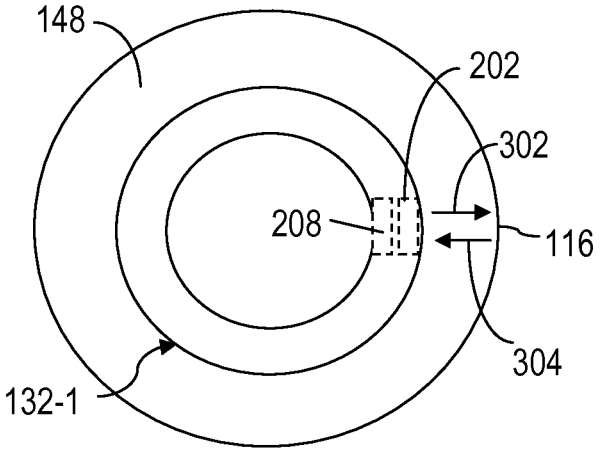
FIG. 3 shows an embodiment of a kick detection sub operating in a wellbore in accordance with principles disclosed herein.

FIG. 3 shows an embodiment of the kick detection sub 132 (132-1) operating in the wellbore 116 in accordance with principles disclosed herein. The kick detection sub 132-1 includes a single acoustic transducer 202 that operates as both an acoustic signal generator and an acoustic signal detector to perform acoustic measurements in pulse-echo mode. Thus, in the kick detection sub 132-1, the acoustic transducer 202 transmits and receives acoustic signals through a single interface with the drilling fluid about the kick detection sub 132-1. The acoustic transducer 202 is mounted on one side of the kick detection sub 132-1, and an acoustic pulse generated by the transducer 202 is directed towards the wall of the wellbore 116. The acoustic pulse emitted from the transducer 202 travels to the wall of the wellbore 116 and is partially reflected back to the transducer 202. The transducer 202 detects the reflected acoustic signal and the kick detection logic 208 measures the amplitude, travel time, and/or other parameters of the reflected acoustic signal.

The kick detection logic 208 measures the round-trip travel time from the transducer 202 to the wall of the wellbore 116 and back. The round-trip travel time is proportional to the acoustic velocity and properties of the drilling fluid filling the annulus 148 between the transducer 202 to the wall of the wellbore 116. In some embodiments, rather than determining the acoustic velocity, an azimuthal average of the reflected signal intensity as a function of wellbore depth is measured and recorded.

Figure 4:
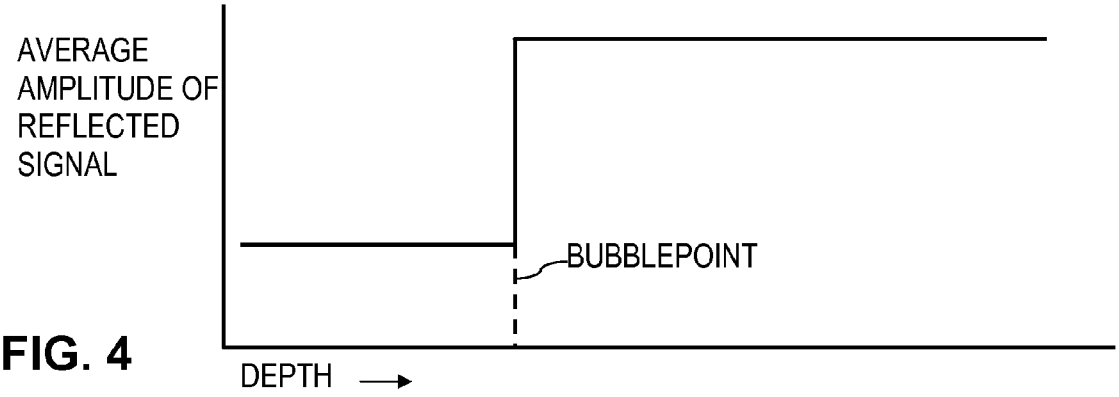
FIG. 4 shows a change in reflected acoustic signal amplitude at a bubble point of a wellbore in accordance with principles disclosed herein.

FIG. 4 shows exemplary azimuthal average amplitude of the reflected signal measured by the kick detection sub 132 as a function of depth of the wellbore 116. As the depth and consequently the hydrostatic drilling fluid column pressure decreases, there is a gradual attenuation of the reflected signal strength caused by a corresponding change in the properties of the drilling fluid due to gas bubbles. At depths where the fluid pressure reduces to the bubble point of the gas dissolved in the fluid, there is a substantial decrease in the reflected signal intensity caused by the newly formed bubbles. However, the front face signal strength, with short travel time, is large. The bubble point pressure of crude oils is typically below 6000 pounds per square inch (psi). Based on the density of the drilling fluid, the approximate depth where the bubble point is expected to occur can be computed as:

$$d=6000/(0.052pg)$$

where:

p is the effective mud density, and g is the gravitational acceleration.

If the kick detection sub 132 observes large attenuation in the reflected signal amplitude (e.g., relative to levels of previously received signals), then the kick detection sub 132 may transmit the acoustic signal measurement data and a warning indicator uphole to the surface to inform an operator of the drilling system 100 of a potential kick. With a typical drilling fluid density of 10 pounds per gallon and normal gravitational acceleration of 32.174 feet per second per second ($f/s^2$), the bubble point depth is about 8000 feet below the surface. The WDP telemetry reaches the surface substantially faster than the drilling fluid and gas, providing ample time for an operator to take remedial action to reduce the effects of the kick.

In the kick detection sub 132-1, the kick detection logic 208 can correlate the travel time, strength of the reverberation pulse and echo from the face of the acoustic transducer 202 with the intensity and travel time of the primary reflected pulse-echo from the wall of the wellbore 116. In gassy drilling fluid, there will be a strong reflection with short travel time due to gas bubbles in front of the face of the acoustic transducer 202. The kick detection logic 208 takes into account the spectrum and features of the pulse-echo from the wall of the wellbore 116 and the front face of the acoustic transducer 202 to estimate the presence of gas in the drilling fluid and compute the diameter of the wellbore 116.

Figure 5:
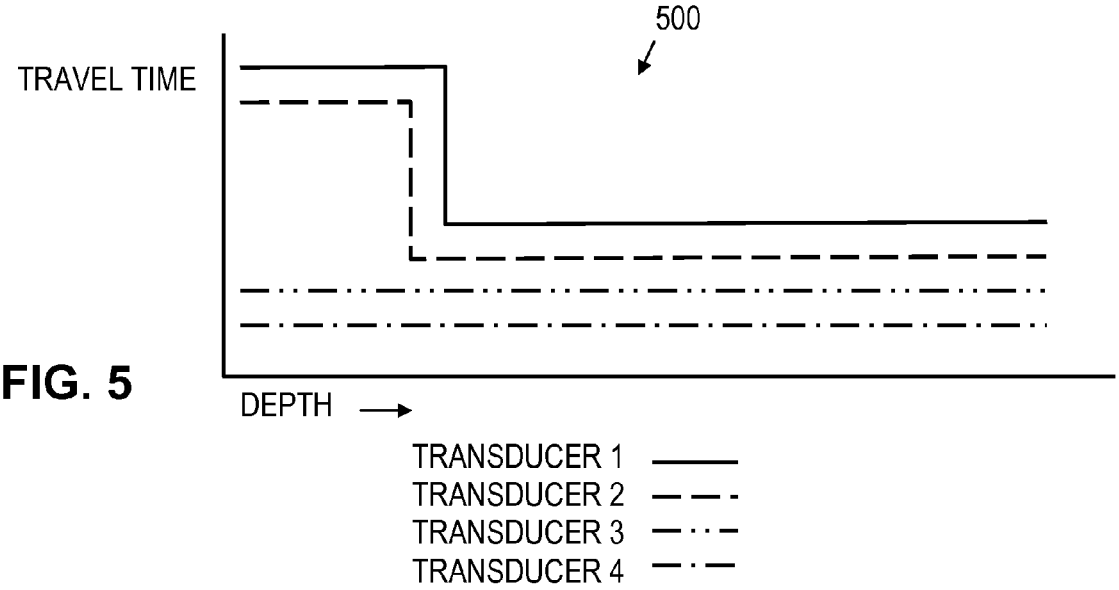
FIG. 5 shows a change in acoustic signal travel time with depth in accordance with principles disclosed herein.

FIG. 5 shows exemplary acoustic signal travel time measured by the kick detection sub 132 as a function of depth or time in accordance with principles disclosed. If the transducers 202 are at fixed depths, the travel time is plotted vs. time. If the transducers 202 are attached to the drill string 108 (e.g., via the kick detection subs 132) and are moving downward as a result of drilling operation, then using the transducer array formed by the distributed kick detection subs 132, when a first transducer 202 has moved from the depth of interest, a second transducer 202 moves to the depth of interest within a suitably short time and measurements of the second transducer 202 provide a next point for the plot 500. The process continues with subsequent transducers 202 in the array so that measurement data is available at a reasonable rate. In the travel time measurements of FIG. 5, gas released at the bubble point causes the travel time to increase because the acoustic velocity of the gas is smaller than that of the liquids (e.g., the drilling fluid). While as a matter of convenience the measurements of FIGS. 4-5 are shown noise-free, in practice, measurements may include superimposed noise caused, for example, by the passage of solid cuttings in front of the acoustic transducers 202.

Figure 6:
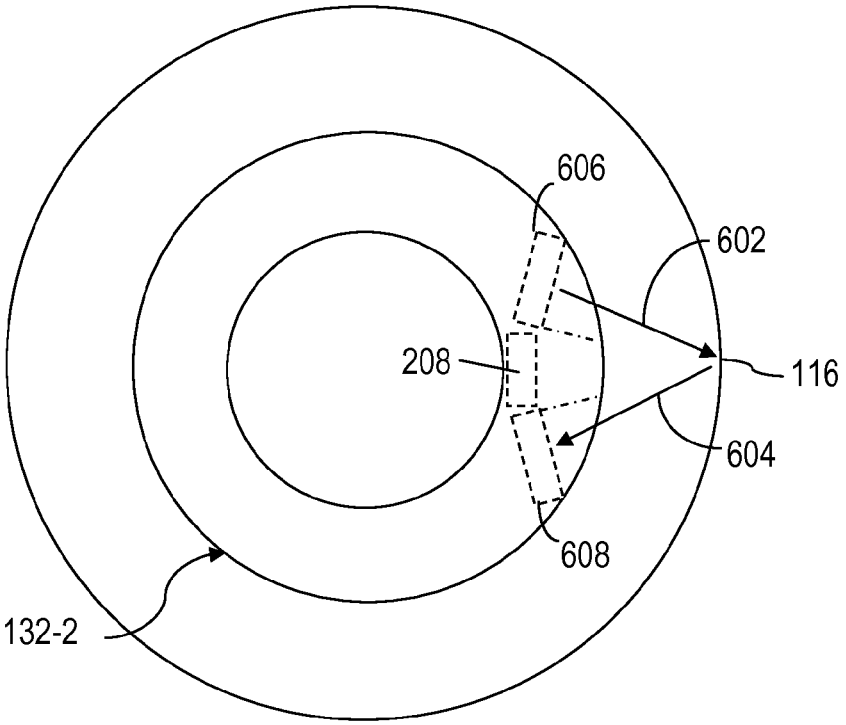
FIG. 6 shows an embodiment of a kick detection sub operating in a wellbore in accordance with principles disclosed herein.

FIG. 6 shows an embodiment of the kick detection sub 132 (132-2) operating in the wellbore 116 in accordance with principles disclosed herein. In the kick detection sub 132-2, the acoustic transducer comprises an acoustic transmitter 606 and an acoustic receiver 608. The acoustic transmitter 606 and the acoustic receiver 608 are disposed in the kick detection sub 132-2 at different azimuthal angles and their radiation direction is radial. The acoustic signal generated by the acoustic transmitter 606 travels through the drilling fluid about the kick detection sub 132-2 to the wall of the wellbore 116. The wall of the wellbore 116 reflects at least a part of the acoustic signal to the acoustic receiver 608. The acoustic receiver 608 detects the reflected acoustic signal and the kick detection logic 208 measures the amplitude and/or travel time of the reflected signal, and determines, based on the amplitude and/or travel time, whether a kick is present in the wellbore 116.

Figure 7:
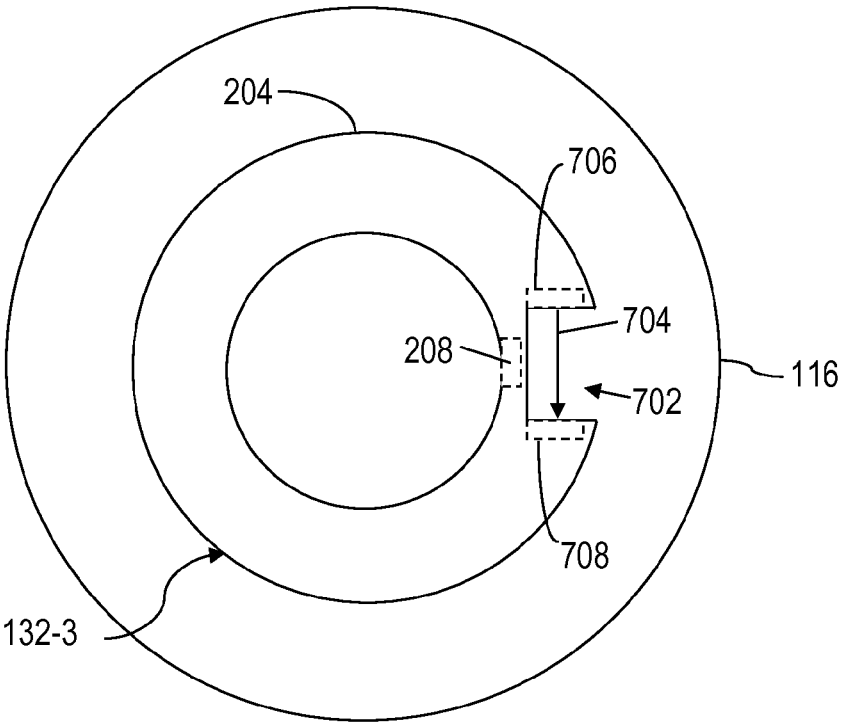
FIG. 7 shows an embodiment of a kick detection sub operating in a wellbore in accordance with principles disclosed herein.

FIG. 7 shows an embodiment of the kick detection sub 132 (132-3) operating in the wellbore 116 in accordance with principles disclosed herein. The kick detection sub 132-3 applies a transmission technique to detect the presence of gas bubbles in the drilling fluid. The kick detection sub 132-3 includes a channel or groove 702 in the outer surface of the housing. The acoustic transducer comprises an acoustic transmitter 706 and an acoustic receiver 708. The acoustic transmitter 606 is disposed in a first wall of the groove 702 and the acoustic receiver 708 is disposed in a second wall of the groove 702 opposite the acoustic transmitter 706 such that acoustic signals generated by the acoustic transmitter 706 propagate in the direction of the acoustic receiver 708. The groove 702 directs drilling fluid to the space between the acoustic transmitter 706 and the acoustic receiver 708. The acoustic signal generated by the acoustic transmitter 706 travels through the drilling fluid in the groove 702 to the acoustic receiver 708. The acoustic receiver 708 detects the acoustic signal and the kick detection logic 208 measures the amplitude and/or travel time of the reflected signal, and determines, based on the amplitude and/or travel time, whether a kick is present in wellbore 116.

Returning now to FIG. 2, the kick detection sub 132 includes a plurality of acoustic transducers 202 spaced along the length of the housing 204. The longitudinally spaced acoustic transducers 202 provide increased depth coverage relative to the kick detection subs 132-1, 2, 3, with some potential loss of bubble positioning accuracy. In one embodiment a first acoustic transducer 202 includes an acoustic transmitter, and other acoustic transducers 202 include an acoustic receiver. For example, acoustic transducer 202A may include an acoustic transmitter and acoustic transducers 202B-D may include an acoustic receiver. In such an embodiment, the acoustic transducer 202A generates an acoustic signal in the drilling fluid that propagates along the length of the wellbore 116 and is detected by the acoustic transducers 202B-D. The acoustic transducers 202 may be longitudinally spaced by several feet in some embodiments. The kick detection logic 208 measures the amplitude and/or travel time of the received acoustic signal, and determines, based on the amplitude and/or travel time, whether a kick is present in wellbore 116.

In some embodiments of the system 100, acoustic transmitters and acoustic receivers are spaced substantially apart (e.g., by one or more lengths of drill pipe 146). For example, referring to FIG. 1, kick detection sub 132-A includes an acoustic transducer 202 comprising an acoustic transmitter, and kick detection subs 132-B, C include an acoustic transducer 202 comprising an acoustic receiver. The acoustic transmitter may be a low-frequency acoustic source (e.g., <20 hertz), such as is used in mud-pulse telemetry. The acoustic receivers are suitable for detection of the low-frequency acoustic signal.

The kick detection logic 208 of the kick detection sub 132-A initiates acoustic signal generation by the acoustic transmitter. In conjunction with the acoustic signal generation, the kick detection logic 208 generates a timing synchronization signal, and transmits the timing synchronization signal to the kick detection subs 132-B, C via the wired drill pipe telemetry network. The kick detection subs 132-B, C receive the timing synchronization signal and, based on the received signal, synchronize acoustic signal detection to acoustic signal generation. The synchronization allows the kick detection subs 132-B, C to measure signal velocity and travel time in addition to attributes derived directly from the received signal, such as amplitude.

With synchronization of the kick detection subs 132, the travel time and velocity of the acoustic signals are compared to detect gas and the bubble point, respectively. The results may be used to generate a record of travel time from the bottom of the wellbore 116 to the surface where measured points are spaced by a predetermined distance, for example 2000 feet. Such a record may provide information analogous to that shown in FIG. 5. An identified increase in the measured travel time is indicative of bubble formation and may trigger a transmission of a kick detection alert. Use of wired drill pipe 146 for telemetry facilitates the time of flight measurement and transmission of kick information to the surface in a timely fashion.

In some embodiments, kick detection subs 132 comprising acoustic receivers are disposed both uphole and downhole of the kick detection sub 132 comprising the acoustic transmitter. In such embodiments, acoustic signals, and associated timing propagation signals, propagate uphole and downhole to the receivers. Each receiving kick detection sub 132 measures the acoustic signals and provides measurements for bubble point location determination.

Figure 8:
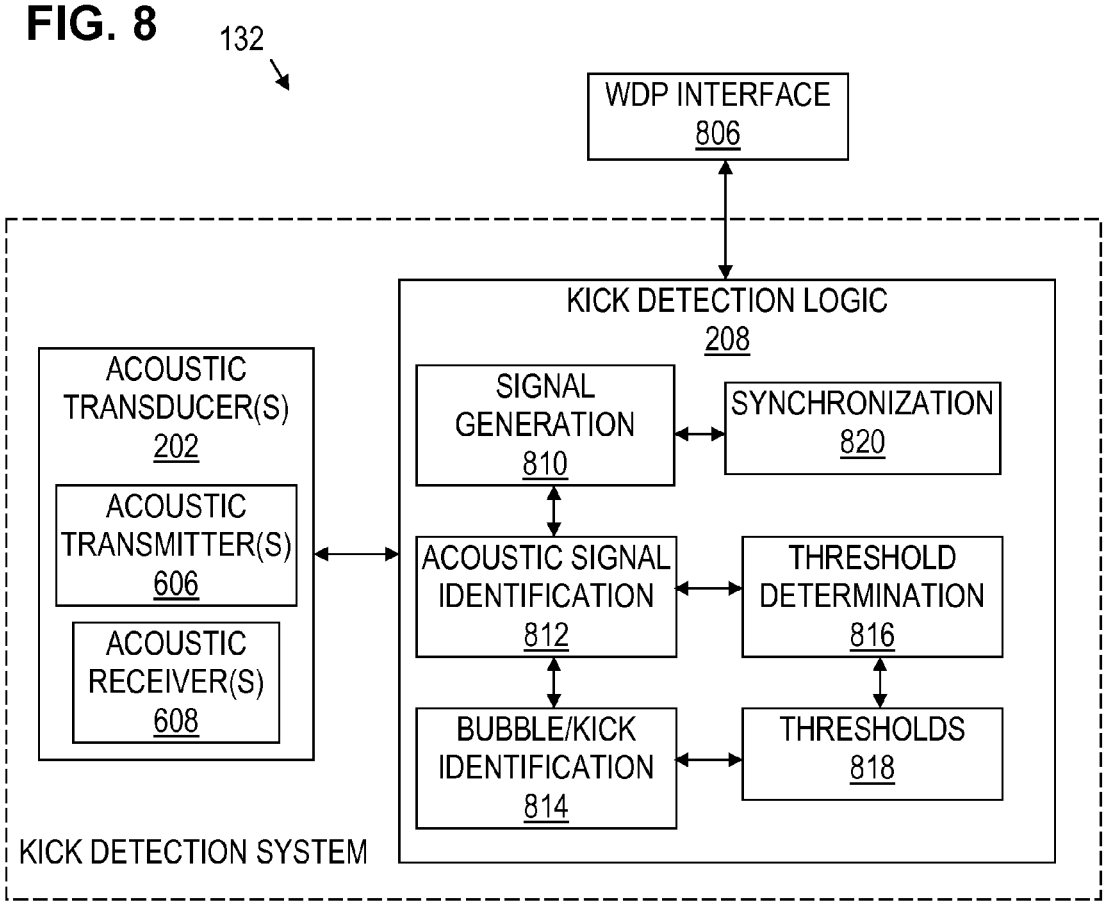
FIG. 8 shows a block diagram for a kick detection sub in accordance with principles disclosed herein.

FIG. 8 shows a block diagram for the kick detection sub 132 in accordance with principles disclosed herein. The kick detection sub 132 includes one or more acoustic transducers 202, kick detection logic 208, and a wired drill pipe telemetry interface 806. The wired drill pipe telemetry interface 806 provides access to the WDP telemetry network. Some embodiments of the kick detection sub 132 are embedded in a WDP repeater sub and access the WDP telemetry network via the telemetry data path (e.g., WDP modulators, demodulators, etc.) of the WDP repeater sub.

The one or more acoustic transducers 202 include acoustic transmitter(s) 606 and/or acoustic receiver(s) 608 which may be implemented using piezoelectric elements, electromagnetic elements, hydrophones, and/or other acoustic signal generation or detection technologies. The one or more acoustic transducers 202 are acoustically coupled to acoustic transmission media outside the sub 132 (e.g., fluid in the wellbore 116), and electrically coupled to the kick detection logic 208.

The kick detection logic 208 includes signal generation 810, acoustic signal identification 812, kick identification 814, threshold determination 816, and synchronization 820. The signal generation 810 controls acoustic signal generation by the acoustic transmitter(s) 606. In some embodiments, the signal generation 810 may construct waveforms and drive the waveforms to the acoustic transmitter(s) 606 for conversion to acoustic signals.

The synchronization 820 may operate in conjunction with the signal generation 810 to determine the timing of acoustic signal generation and/or to report the timing of acoustic signal generation to other of the kick detection subs 132. Accordingly, the synchronization 820 may transmit a signal specifying acoustic signal generation time to other kick detection subs 132 via the wired drill pipe telemetry interface 806. Similarly, the synchronization 820 may receive synchronization information from other of the kick detection subs 132 via the wired drill pipe telemetry interface 806, and provide the synchronization information to the kick identification 814 for travel time determination or other purposes.

The acoustic signal identification 812 receives electrical waveforms representative of the acoustic signals detected by the acoustic receiver(s) 608 and may amplify, filter, digitize, and/or apply processing to the waveforms. For example, the acoustic signal identification 812 may correlate, or otherwise compare, received waveforms against transmitted waveforms to identify the received waveform as a reflected form of the transmitted waveform.

The kick identification 814 processes the received waveform, or information derived therefrom. In one embodiment, the kick identification 814 may measure the amplitude and/or travel time of the received waveform, and compare the amplitude and/or travel time to predetermined threshold values 818 used to identify whether the waveform amplitude and/or travel time has been affected by the presence of gas bubbles in the drilling fluid. For example, if the amplitude of the waveform is below an amplitude threshold 818, or the travel time of the waveform exceeds a travel time threshold 818, then the kick identification 814 may deem the received waveform to have been affected by the gas bubbles that form a kick. If a kick is identified, then the kick identification 814 transmits waveform information and/or a kick alert to the surface via the wired drill pipe interface 806.

The threshold determination 816 sets the threshold values 818 applied by the kick identification 814 to determine whether a kick is present in the wellbore 116. The threshold determination 816 set the thresholds based on amplitude and/or travel time information for acoustic signals previously received by the kick detection sub 132. For example, amplitude and/or travel time may be averaged or filtered and thresholds set at a suitable offset from the average or filter output.

Various components of the kick detection sub 132 including at least some portions of the kick detection logic 208 can be implemented using a processor executing software programming that causes the processor to perform the operations described herein. In some embodiments, a processor executing software instructions causes the kick detection sub 132 to generate acoustic signals, identify received acoustic signals, or identify the presence of gas bubbles in the drilling fluid. Further, a processor executing software instructions can cause the kick detection sub 132 to communicate kick information to the surface via wired drill pipe telemetry.

Suitable processors include, for example, general-purpose microprocessors, digital signal processors, microcontrollers, and other instruction execution devices. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems. Software programming (i.e., processor executable instructions) that causes a processor to perform the operations disclosed herein can be stored in a computer readable storage medium. A computer readable storage medium comprises volatile storage such as random access memory, non-volatile storage (e.g., FLASH storage, read-only-memory), or combinations thereof. Processors execute software instructions. Software instructions alone are incapable of performing a function. Therefore, in the present disclosure, any reference to a function performed by software instructions, or to software instructions performing a function is simply a shorthand means for stating that the function is performed by a processor executing the instructions.

In some embodiments, portions of the kick detection sub 132, including portions of the kick detection logic 208 may be implemented using dedicated circuitry (e.g., dedicated circuitry implemented in an integrated circuit). Some embodiments may use a combination of dedicated circuitry and a processor executing suitable software. For example, some portions of the kick detection logic 208 may be implemented using a processor or hardware circuitry. Selection of a hardware or processor/software implementation of embodiments is a design choice based on a variety of factors, such as cost, time to implement, and the ability to incorporate changed or additional functionality in the future.

Figure 9:
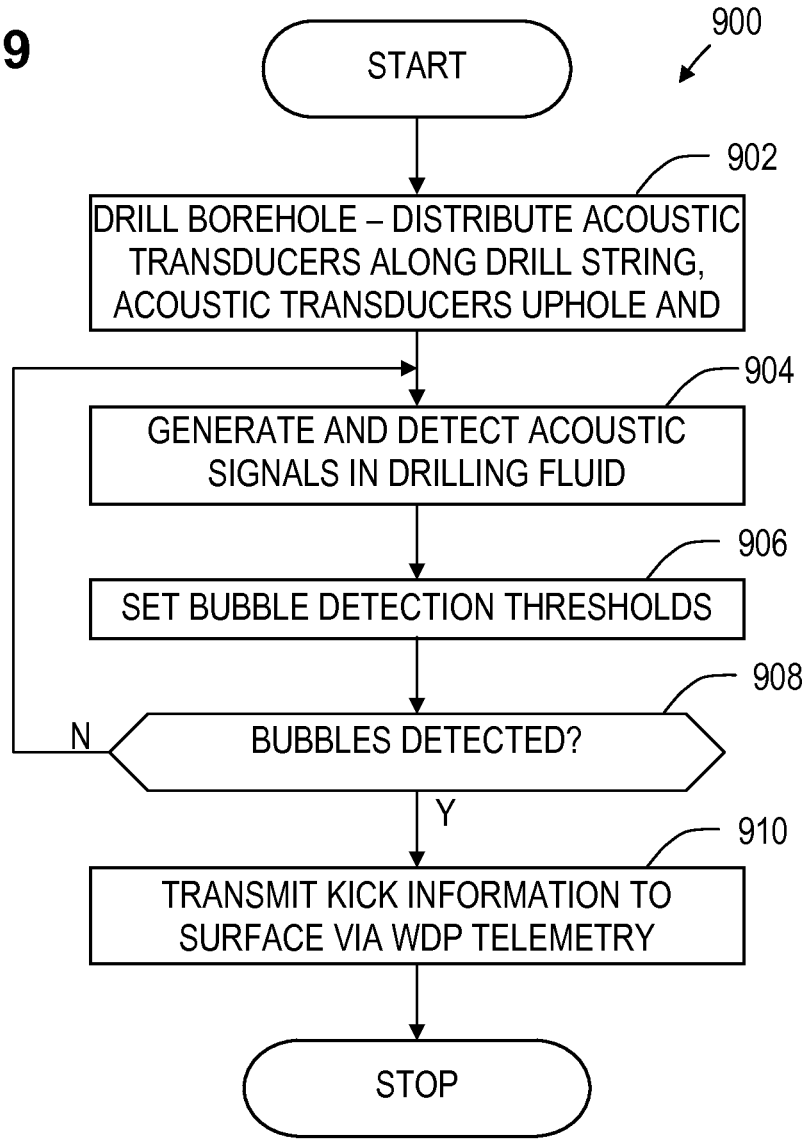
FIG. 9 shows a flow diagram for a method for kick detection in a wellbore in accordance with principles disclosed herein.

FIG. 9 shows a flow diagram for a method 900 for drilling a relief well in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 900 can be performed by a processor executing instructions read from a computer-readable medium.

In block 902, the wellbore 116 is being drilled. The drill string 108 is assembled as the wellbore 116 is drilled, and acoustic transducers 202 are distributed at intervals along the drill string 108. Distribution of the acoustic transducers 202 along the drill string 108 allows for an acoustic transducer 202 to be proximate the bubble point of the wellbore 116 for kick detection no matter the depth of the bubble point. Thus, as one acoustic transducer 202 descends in the wellbore 116 away from the bubble point, another acoustic transducer 202 descends to the bubble point. The drill pipe used in the drill string 108 is wired drill pipe. The acoustic transducers 202 may be disposed in kick detection subs 132 interspersed among the wired drill pipes. In some embodiments the kick detection subs 132 may be or may be incorporated in wired drill pipe telemetry repeaters that are interspersed among the wired drill pipes, and provide signal regeneration for wired drill pipe telemetry signals.

In block 904, the acoustic transducers 202 induce acoustic signals in the drilling fluid in the annulus 148 of the wellbore 116. The acoustic transducers 202 detect the induced acoustic signals by reflection from the wall of the wellbore 116 or other downhole structures, or directly by direct reception from the transmitting acoustic transducer 202.

In block 906, the kick detection sub 132 processes the detected acoustic signals. The processing may include determining the travel time of the detected acoustic signal from source acoustic transducer 202 to the detecting acoustic transducer 202, and/or determining the level/amplitude/intensity of the detected acoustic signal. The kick detection sub 132 determines threshold values that are compared to parameters of the detected acoustic signal. The threshold values may be derived from the parameters (e.g., average amplitude, average time of flight, etc.) of acoustic signals previously detected in the borehole 116.

In block 908, the kick detection sub 132 applies the threshold values to the detected acoustic signals and determines whether gas bubbles are present in the drilling fluid between the transmitting and receiving acoustic transducers 202. For example, if the travel time of the detected acoustic signal exceeds a travel time threshold, or the amplitude of the detected acoustic signal is below an amplitude threshold, then the kick detection sub 132 may determine that gas bubbles are present in the drilling fluid and that the gas bubbles caused the observed changes in the parameters of the detected acoustic signal.

If the kick detection sub 132 determines that gas bubbles are present in the drilling fluid, then, in block 910, the kick detection sub 132 may deem a kick to be present in the wellbore 116 and transmit kick information to the surface via the wired drill pipe telemetry network. The kick information may include identification of the presence of a kick, the location where the kick was detected, and the signal parameters applied to identify the kick (e.g., amplitude and/or travel time of the detected acoustic signal, and threshold values). Based on the kick information, a drilling control system or operator at the surface may act to reduce the effects of the kick.

Figure 10:
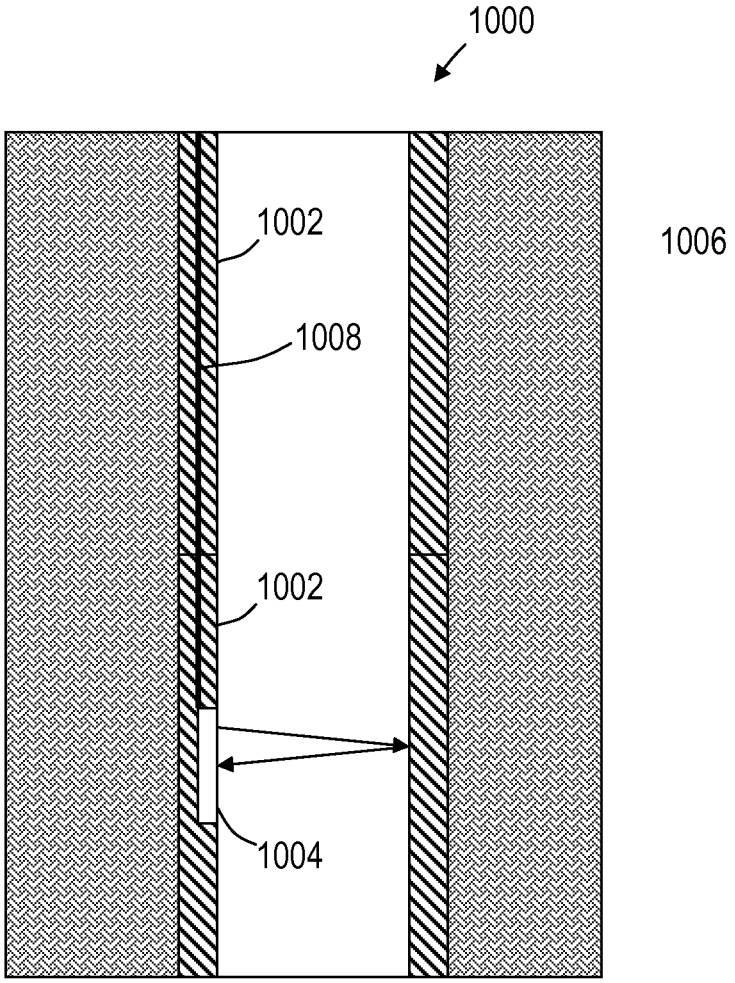
FIG. 10 shows an embodiment of a system for kick detection in a cased well accordance with principles disclosed herein.

FIG. 10 shows an embodiment of a cased well 1000 configured for kick detection in accordance with principles disclosed herein. The cased well 1000 includes a casing string comprising casing pipes 1002 affixed to the wall of the wellbore 1006. The casing 1002 includes a kick detection system 1004 comprising acoustic transducer(s) that generate acoustic signals in the fluid within the casing and detect the reflections of the generated acoustic signals from the casing wall opposite the transducer(s) or from other structures disposed within the casing 1002. In various embodiments of the casing 1002, the acoustic transducers 202 may be arranged as described herein with regard to the kick detection subs 132 of FIGS. 1-3, 6, and 7, and detect bubble formation based on reflected or directly received acoustic signals as described with regard to the kick detection subs 132 of FIGS. 1-3, 6, and 7. The acoustic transducer(s) 202 may be disposed in the wellbore 1006 at a depth where a bubble point is expected to occur.

The kick detection system 1004 may also include the kick detection logic 208 as described herein for detecting gas bubbles within the cased well 1000. Kick information may be transmitted to the surface via a casing telemetry system. Some embodiments of the casing 1002 include signal conduction media 1008 similar to that of wired drill pipe described herein for transmission of data between the surface and the kick detection system 1004.

The above discussion is meant to be illustrative of principles and various exemplary embodiments of the present invention. Numerous variations and modifications will become apparent to those skilled in the art once the above disclosure is fully appreciated. For example, embodiments of the invention have been described with reference to a wired drill pipe telemetry system. Some embodiments may employ other downhole telemetry systems, such acoustic telemetry systems, wireline telemetry systems, etc. It is intended that the following claims be interpreted to embrace all such variations and modifications.

What is claimed is:

1. A method for kick detection, comprising:

distributing kick detection subs along a drill string at longitudinal positions separated by at least one whole drill pipe, each of the kick detection subs comprising an acoustic transducer arranged to detect gas bubbles in drilling fluid about the drill string;

drilling a borehole with the drill string; and during the drilling:

via an acoustic transmitter of the acoustic transducer that is disposed at a first azimuthal angle, transferring an acoustic signal into the drilling fluid adjacent the acoustic transmitter;

via an acoustic receiver of the acoustic transducer that is disposed in the at a second azimuthal angle, receiving an acoustic signal propagated through the drilling fluid adjacent the acoustic receiver;

detecting whether gas bubbles are present in the drilling fluid via the transferring and the receiving; and transmitting information derived from the detecting to the surface.

2. The method of claim 1, wherein the drill string comprises wired drill pipes, and the distributing comprises positioning wired drill pipe repeater subs at intervals along the drill string; wherein the wired drill pipe repeater subs comprise the kick detection subs.

3. The method of claim 1, wherein the receiving comprises detecting a reflection of the acoustic signal from a wall of the borehole.

4. The method of claim 3, further comprising:

determining that gas bubbles are present in the drilling fluid responsive to the reflection having an amplitude that is lower than a predetermined signal level; and setting the predetermined signal level based on an amplitude of reflection previously detected by at least one of the acoustic transducers.

5. The method of claim 3, further comprising:

vibrating a surface of the acoustic transmitter to generate the acoustic signal and;

detecting vibration of the surface induced via the drilling fluid to detect the reflection.

6. The method of claim 1, further comprising:

transmitting the acoustic signal through drilling fluid disposed in a groove in an outer wall of a wired drill pipe repeater sub;

wherein the acoustic receiver is disposed on a wall of the groove that is opposite a wall of the groove that includes the acoustic transmitter that transmits the acoustic signal; and determining that gas bubbles are present in the drilling fluid based on at least one of an increase in travel time of the acoustic signal relative to a previously received acoustic signal and a decrease in amplitude of the acoustic signal relative to a previously received acoustic signal.

7. The method of claim 1, further comprising:

transmitting the acoustic signal into the drilling fluid by an acoustic transmitter disposed on an outer surface of a sub;

receiving the acoustic signal by a plurality of acoustic receivers disposed on the outer surface of the sub; wherein each of the acoustic receivers is longitudinally offset from the acoustic transmitter and from each other of the acoustic receivers;

determining that gas bubbles are present in the drilling fluid based on at least one of an increase in travel time of the acoustic signal relative to a previously received acoustic signal and a decrease in amplitude of the acoustic signal relative to a previously received acoustic signal.

8. The method of claim 1, wherein the acoustic transmitter is disposed in a first sub of the drill string and the acoustic receiver is disposed in a second sub of the drill string.

9. The method of claim 8, further comprising:

generating, by the first sub, a timing signal in conjunction with initiation of generating the acoustic signal;

transmitting the timing signal from the first sub to the second sub via wired drill pipe;

measuring, by the second sub, a time of flight of the acoustic signal based on the timing signal received by the second sub; and determining whether gas bubbles are present in the drilling fluid between the first sub and second sub based on the measured time of flight of the acoustic signal.

10. A system for detecting a kick in a wellbore, comprising:

a drill string comprising:

a plurality of sections of drill pipes; and a plurality of kick detection subs interspersed among the sections of drill pipes, each of the kick detection subs comprising:

an acoustic transducer comprising:

an acoustic transmitter configured to transfer an acoustic signal into drilling fluid adjacent the acoustic transmitter; and an acoustic receiver configured to detect an acoustic signal propagated through the drilling fluid adjacent the acoustic receiver;

wherein the acoustic transmitter is disposed in the kick detection sub at a first azimuthal angle and the acoustic receiver is disposed in the kick detection sub at a second azimuthal angle; and kick detection circuitry coupled to the acoustic transducer, the kick detection circuitry configured to:

detect gas bubbles in the wellbore based on acoustic signals received by the acoustic transducer;

determine whether a kick is present in the wellbore based on the detected gas bubbles; and transmit information indicating whether a kick is present to the surface.

11. The system of claim 10, wherein the acoustic transmitter and the acoustic receiver comprise a shared acoustic signal transfer surface.

12. The system of claim 10, wherein the acoustic transmitter is disposed on a first wall of a groove in the kick detection sub, and the acoustic receiver is disposed on a second wall of the groove, wherein the second wall is opposite the first wall.

13. The system of claim 10, wherein the acoustic transmitter is longitudinally offset from the acoustic receiver on the kick detection sub.

14. The system of claim 10, wherein the kick detection circuitry is configured to detect the gas bubbles based on an acoustic signal detected, by the acoustic transducer, having at least one of an amplitude that is lower than a predetermined signal level and a travel time that is greater that a predetermined time.

15. The system of claim 14, wherein the kick detection circuitry is configured to set the predetermined signal level based on an amplitude of an acoustic signal previously detected by the acoustic transducer.

16. The system of claim 10, wherein the acoustic transducer of a first of the kick detection subs is configured to:

generate an acoustic signal, and transmit a synchronization signal to a second of the kick detection subs, the synchronization signal indicating the timing of the generation of the acoustic signal.

17. The system of claim 16, wherein the kick detection circuitry of the second of the repeater subs is configured to:

measure a time of flight of the acoustic signal generated by the first of the kick detection subs based on the synchronization signal; and determine whether gas bubbles are present in the wellbore between the first and second of the kick detection subs based on the measured time of flight of the acoustic signal generated by the first of the kick detection subs.

18. The system of claim 10, wherein each of the kick detection subs is a wired drill pipe telemetry repeater sub.

19. The system of claim 10, wherein the drill pipes are wired drill pipes and the kick detection circuitry is configured to transmit the information indicating whether a kick is present to the surface via the wired drill pipes.

20. The system of claim 10, wherein the kick detection circuitry is configured to determine speed of the gas bubbles in the wellbore based on a difference in detection time of the gas bubbles by two acoustic transducers.

21. The system of claim 10, wherein the kick detection circuitry is integrated into the drill pipes.

22. Apparatus for in wellbore kick detection, comprising:

a plurality of wired drill pipe (WDP) repeaters configured to retransmit signals through a WDP telemetry system disposed in the wellbore, and spaced by interposing wired drill pipes, each of the WDP repeaters comprising:

a tubular housing comprising a groove in an outer surface of the housing;

a kick detection system, the kick detection system comprising:

one or more acoustic transducers; and kick detection logic coupled to the one or more acoustic transducers, the kick detection logic configured to:

identify the presence and location of a kick in the wellbore based on acoustic signals indicative of bubble formation received by the one or more acoustic transducers; and communicate information identifying the presence and location of the kick to the surface via the WDP telemetry system;

wherein an acoustic transmitter of the one or more acoustic transducers is disposed in a first side wall of the groove; and an acoustic receiver of the one or more acoustic transducers is disposed in a second side wall of the groove opposite the acoustic transmitter.

23. The apparatus of claim 22, wherein each of the one or more acoustic transducers comprises at least one of:

an acoustic transceiver having a single acoustic interface;

an acoustic transmitter and an acoustic receiver disposed at different azimuthal angles; and an acoustic receiver longitudinally offset from an acoustic transmitter.

24. The apparatus of claim 22, wherein the kick detection logic is configured to:

identify the presence of a kick based on an acoustic signal detected, by the one or more acoustic transducers, having at least one of an amplitude that is lower than a predetermined signal level and a travel time that is greater that a predetermined time; and determine at least one of the predetermined signal level and the predetermined travel time based on acoustic signals previously received by the one or more acoustic transducers.

25. The apparatus of claim 22, wherein the kick detection logic is configured to:

initiate generation of a first acoustic signal;

transmit a first synchronization signal via the WDP telemetry system, the first synchronization signal indicating timing of the generation of the first acoustic signal;

receive a second synchronization signal via the WDP telemetry system, the second synchronization signal indicating timing of the generation of a second acoustic signal at a different one of the WDP repeaters;

measure a time of flight of the second acoustic signal based on the received second synchronization signal; and determine whether a kick is present in the wellbore based on the measured time of flight of the second acoustic signal.

26. A system for kick detection in a cased wellbore, comprising:

a casing string disposed in the wellbore, the casing string comprising a plurality of wired casing pipes comprising a casing telemetry system and affixed to a wall of the wellbore;

one or more of the wired casing pipes comprising:

a groove in an inner surface of the casing pipe;

an acoustic transducer, wherein an acoustic transmitter of the acoustic transducer is disposed in a first side wall of the groove, and an acoustic receiver of the acoustic transducer is disposed in a second side wall of the groove opposite the acoustic transmitter; and a kick detection system coupled to the acoustic transducer, the kick detection system configured to:

identify the presence of gas in the wellbore based on acoustic signals indicative of bubble formation received by the one or more acoustic transducers; and communicate information identifying the presence of the gas in the wellbore to the surface via the casing telemetry system.

27. The system of claim 26, wherein the acoustic transducer comprises at least one of:

an acoustic transceiver having a single acoustic interface;

an acoustic transmitter and an acoustic receiver disposed at different azimuthal angles; and an acoustic receiver longitudinally offset from an acoustic transmitter.

28. The system of claim 26, wherein the kick detection logic is configured to:

identify the presence of the gas based on an acoustic signal detected, by the acoustic transducer, having at least one of an amplitude that is lower than a predetermined signal level and a travel time that is greater that a predetermined time; and determine at least one of the predetermined signal level and the predetermined travel time based on acoustic signals previously received by the acoustic transducer.

29. The system of claim 26, wherein the casing string is configured to position one or more of the casing pipes at a depth of the wellbore at which gas comes out of solution in the wellbore fluid.

* * * * *